US006406388B1

(12) United States Patent
Davis et al.

(10) Patent No.: US 6,406,388 B1
(45) Date of Patent: Jun. 18, 2002

(54) GAME RACQUET WITH SLIDE ON, CUSHIONED HANDLE

(76) Inventors: Stephen J. Davis, 11A Smokerise Village 2, New Hope, PA (US) 18938; Lawrence P. Monty, 54 Brier Rd., Loeminster, MA (US) 01453

( * ) Notice: Subject to any disclaimer, the term of this patent is extended or adjusted under 35 U.S.C. 154(b) by 0 days.

(21) Appl. No.: 07/373,331

(22) Filed: Jun. 29, 1989

(51) Int. Cl.[7] ..... A63B 49/08; A63B 59/06; A63B 53/14

(52) U.S. Cl. ..... 473/538; 473/206; 473/299; 81/177.7; 81/489

(58) Field of Search ..... 273/73 J, 73 R, 273/75, 81.2, 165

(56) References Cited

U.S. PATENT DOCUMENTS

| | | | | | |
|---|---|---|---|---|---|
| 399,340 | A | * | 3/1889 | Morgan | 273/75 |
| 1,523,638 | A | | 1/1925 | Freedlander | |
| 1,581,647 | A | * | 4/1926 | Layton | 273/73 J |
| 2,236,414 | A | * | 3/1941 | Reach | 273/73 J |
| 3,072,955 | A | | 1/1963 | Mitchell | |
| 3,189,069 | A | | 6/1965 | Stowell | |
| 3,344,684 | A | | 10/1967 | Steere | |
| 3,489,031 | A | * | 1/1970 | Meier | 273/73 J |
| 3,501,148 | A | * | 3/1970 | Cheris | 273/75 |
| 3,889,951 | A | * | 6/1975 | Schaefer et al. | 273/73 F |
| 3,915,782 | A | | 10/1975 | Davis | |
| 3,950,838 | A | * | 4/1976 | Oseroff | 29/407 |
| 4,149,721 | A | * | 4/1979 | Strickland | 273/73 J |
| 4,953,862 | A | * | 9/1990 | Uke et al. | 273/75 |
| 5,034,082 | A | | 7/1991 | Nolan | |

FOREIGN PATENT DOCUMENTS

| | | | | |
|---|---|---|---|---|
| DE | 3101687 | | 8/1982 | |
| DE | 3341256 | | 5/1985 | |
| GB | 0199786 | * | 6/1923 | 273/75 |

* cited by examiner

*Primary Examiner*—Paul T. Sewell
(74) *Attorney, Agent, or Firm*—Skadden, Arps, Slate, Meagher & Flom LLP

(57) ABSTRACT

A tennis racquet includes a frame with a head and a shaft portion. The shaft portion has an outer periphery with outside surfaces arranged generally in an octagonal configuration. A handle includes a preformed core or "pallet". The pallet is molded of a solid elastomeric material, e.g. thermoplastic rubber, with a hollow interior having surfaces sized to conform to the outside surfaces of the shaft portion of the frame. Further, an array of holes is formed on the outside surface of the pallet, in selected gripping areas, for a comfortable grip and to reduce shock and vibration. The pallet may include an overwrap, such as cloth-backed polyurethane, which is preferably soft and flexible enough to retain feel of the pallet.

14 Claims, 4 Drawing Sheets

GAME RACQUET WITH SLIDE ON, CUSHIONED HANDLE

BACKGROUND OF THE INVENTION

The present invention is a novel handle construction for a tennis racquet or other sports implements having a shaft. It is particularly applicable to game racquets of the type having a built-up handle wrapped by an outside gripping material, e.g. racquets for tennis, squash, and racquetball.

Tennis racquet frames include a head, which supports strings for hitting the ball, and a handle which is gripped by the player to impart the hitting stroke. The handle, which is mounted on a shaft portion of the racquet frame, customarily includes a core of wood, plastic, or other material wrapped by leather or synthetic gripping material, and is shaped to provide a firm, comfortable grip. Conventionally, the handle is built up directly on the shaft portion of the frame so that the handle and frame become, for structural purposes, a unitary member. Other game racquets have similar constructions.

Tennis racquets come in a variety of models, each of which is offered in a range of handle sizes. As a practical matter, tennis pro shops and other sporting goods retailers normally sell racquets of more than one manufacturer, necessitating a substantial inventory of tennis racquets of different manufacturers, models, and grip sizes.

Deer U.S. Pat. No. 3,547,440 and Snauwaert U.S. Pat. No. 3,638,943 recognize the inventory problem that is created by having to stock tennis racquets in multiple grip sizes. Each of these patents proposes tennis racquets having handles which are provided with special mounting constructions so that the handles may slide onto the shaft of the tennis racquet frame and be attached by screws.

Trysinsky U.S. Pat. No. 4,506,887 discloses another tennis racquet handle assembly in which the handle is separate from the frame. As in the case of Deer and Snauwaert, Trysinky proposes a rather complex construction for attaching the handle to the racquet by screws.

Tennis racquets must be capable of withstanding considerable force upon impact of the ball. Furthermore, it is critical for the handle to be securely attached to the racquet frame shaft. This is a principal reason for building the handle directly about the frame, i.e., so as to form a unitary structure. In order to achieve the same solid structure using a handle with a mechanical mounting structure and screws, as in the three proposals discussed above, it would be necessary to manufacture each of the pieces with great precision so as to produce a tight fit on the racquet shaft. This, along with the generally complex structure of these pieces, is undesirable from the standpoint of cost. Even if the handle could be solidly mounted on the racquet shaft initially, the repeated impact and vibration of striking the tennis ball might tend to loosen the handle from the frame at the stress bearing locations, e.g. the screws, over the life of the racquet.

While the aforementioned patents recognize the desirability of a tennis racquet with a separately mounted handle, none suggest a construction that is practical from a commercial and structural standpoint, and tennis racquet handles continue to be formed individually on the frame during construction of the racquet.

SUMMARY OF THE INVENTION

The present invention is a tennis racquet with a handle formed from a novel slide-on, resilient, one piece core or "pallet". The pallet is formed separate from the racquet frame proper, and is thereafter force fit on the shaft portion of the frame. The pallet is preferably formed by injection molding, which makes it possible to control the dimensions and weight of the pallet more accurately.

A racquet according to the invention includes a frame with a head and a shaft portion extending therefrom. The shaft portion of the frame has an outer periphery that is uniform along a length coextensive with the handle and with top, bottom, side, and preferably diagonal outside surfaces arranged generally in an octagonal configuration. Preferably, the frame is formed of a molded tubular profile member, the opposite ends of which converge to form the shaft.

The handle is in the form of a resilient, tubular pallet with a uniform hollow interior conforming to the shape of the shaft. In the case of an octagonal shape shaft, the pallet interior has upper, lower, lateral, and angled internal surfaces arranged to define a generally octagonal configuration, and sized to conform to the top, bottom, side, and diagonal outside surfaces of the frame. Preferably, the internal surfaces are fluted with a series of longitudinally extending grooves.

The outer surface of the pallet may be molded to any desired shape. In an exemplary embodiment, the outer surface is formed as a conventional octagonal grip, with a flared butt portion.

A pallet according to the invention is further formed with an array of holes in the top, bottom, and preferably diagonal outside surfaces, that extend substantially, but not all the way, through the pallet wall toward the hollow interior. The number, size, and spacing of the holes may be varied to customize the degree of elasticity along the length of the handle and around its circumference.

The pallet is formed of a solid elastomer, e.g. thermoplastic or thermoset rubber, preferably, but not limited to a relatively soft rubber (e.g. 55–60 Shore A Durometer), rather than a foam material. Because of the holes, the material, even though a solid rubber, will have some resiliency when gripped, but because it is a solid rubber it is sufficiently firm not to twist or significantly deform when the ball is hit (i.e. is not spongy). Moreover, because the enhanced resiliency is provided by holes on the outside surface, the pallet has the characteristic of being relatively more resilient on its outside surface, in areas gripped by hand, and relatively firmer, providing greater torsion resistance, in the interior, where the pallet engages the shaft. Because in the preferred embodiment the holes are provided only in selected gripping areas, the pallet remains relatively firm in other areas, i.e. areas not containing the holes (the sides). The thermoplastic rubber not only provides a cushioned feel but also helps dampen vibrations. Also, such material has sufficient memory to keep its shape and will not break down like some elastic foams.

Preferably, the pallet is wrapped, for a better grip, with a soft flexible outer wrap, such as known cloth-backed polyurethane. Such material is very soft and is flexible enough so that when the pallet is gripped, the wrap does not significantly affect the feel of the resilient pallet. Alternatively, the pallet can be used alone as the handle.

A manufacturer may maintain separate stocks of racquets and handles, thus avoiding periodic shortages and overstocks of racquets. Alternatively, a manufacturer may supply racquets and handles, in different grip sizes, separately to retailers, where the racquet is custom finished at the point of sale.

For a better understanding of the invention, references is made to the following detailed description of a preferred embodiment, taken in conjunction with the drawings accompanying the application.

DETAILED DESCRIPTION OF A PREFERRED EMBODIMENT

Figures 1, 2:
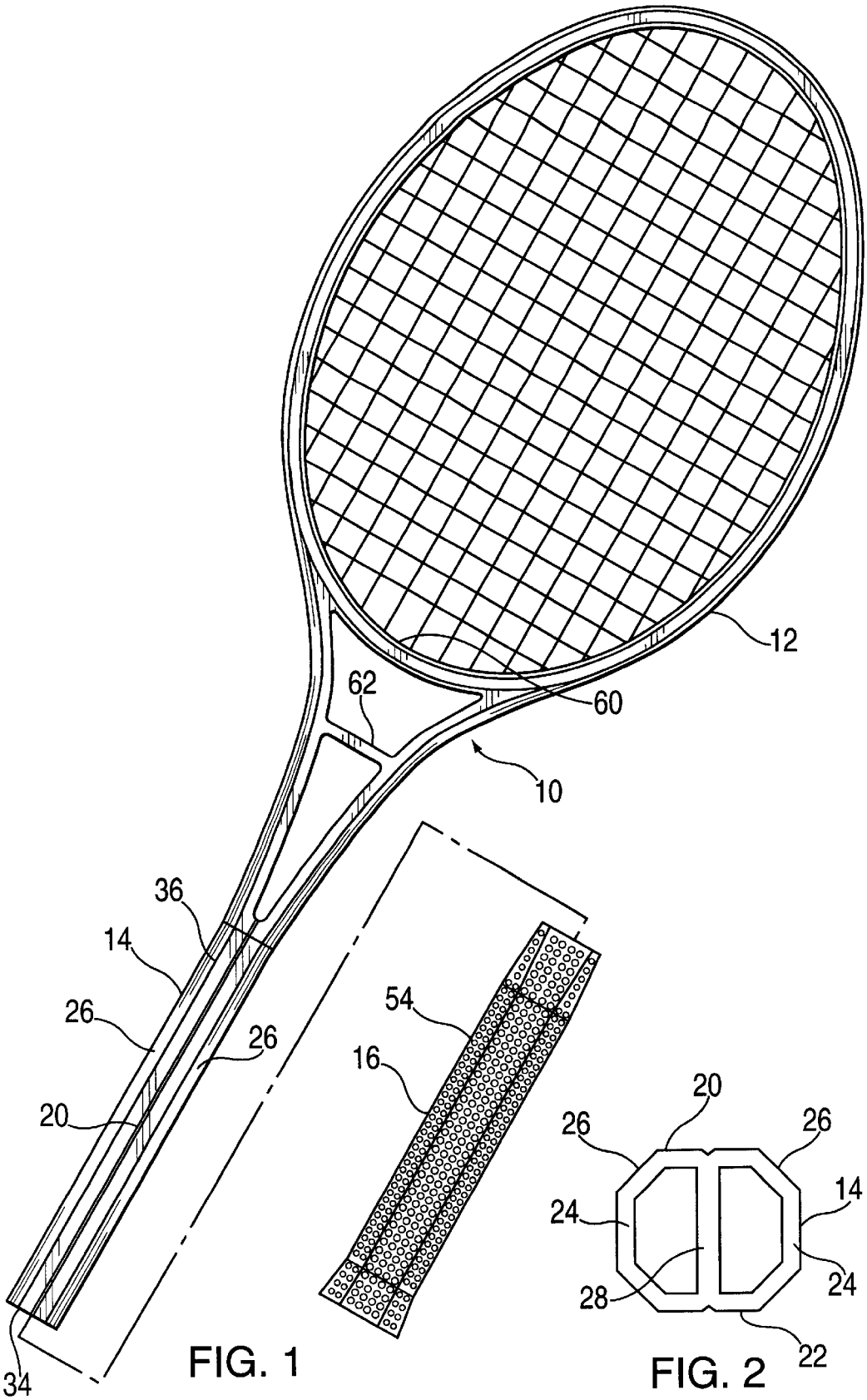
FIG. 1 is a plan view of a tennis racquet in accordance with the invention, shown with the frame and a slide-on pallet prior to assembly.
FIG. 2 is an end view of the shaft portion of the racquet frame shown in FIG. 1, on an enlarged scale.

A tennis racquet in accordance with the invention includes a frame 10 having a head portion 12 and a shaft portion 14. The frame 10 may include a throat piece 60 and one or more cross-pieces 62. A handle, which is formed from a one-piece core or "pallet" 16, slides over the shaft portion 14 of the frame 10 for mounting thereon, as described further below.

The frame 10 may be formed of a tubular material, such as a fiber-impregnated resin material, e.g. graphite (carbon fiber-impregnated resin), which is molded into the shape of a tennis racquet frame in a heated mold, in accordance with known processes. The frame can be made of other materials as well, including other tubular profiles (e.g. aluminum) or wood.

Referring to FIG. 2, the shaft portion 14 of the racquet frame includes opposed top 20 and bottom 22 surfaces, opposed sides 24, and opposed diagonal 26 surfaces arranged generally in an octagonal configuration. The top and bottom surfaces 20, 22 lie in planes parallel to the stringing plane of the head 12 of the racquet 10. The shaft portion 14 outer periphery is uniform along a length coextensive with the handle pallet 16.

The pallet 16 is made of a solid elastomeric material (as opposed to a foamed material), preferably thermoplastic rubber, molded as a one piece unit. Referring to FIGS. 3–8, the pallet 16 is generally octagonal in outside configuration, although the top and bottom surfaces 41, 42 are somewhat wider than the side surface 43 for a more comfortable grip. The pallet 16 has a hollow interior 44 with upper 46, lower 48, lateral 50 and angled 52 inside surfaces. The inside surfaces are arranged to define a generally octagonal configuration and which conform to the top 20, bottom 22, side 24, and diagonal 26 outer surfaces of the shaft 14 and form contact surfaces for engaging the shaft 14, when the pallet 16 is mounted on the frame 10. Preferably, the width (distance between the lateral surfaces 50) is slightly greater than the height of the interior space, and the shaft portion 14 is molded correspondingly so that the distance between the sides 24 is greater than the distance between top 20 and bottom 22 surfaces. The pallet may include longitudinal grooves 51 spaced around the inside surfaces 46, 48, 50, and 52. In the example shown, grooves 51 of approximately 1 mm width and 1 mm depth are spaced apart a distance of about 1 mm around the interior.

Figure 3:
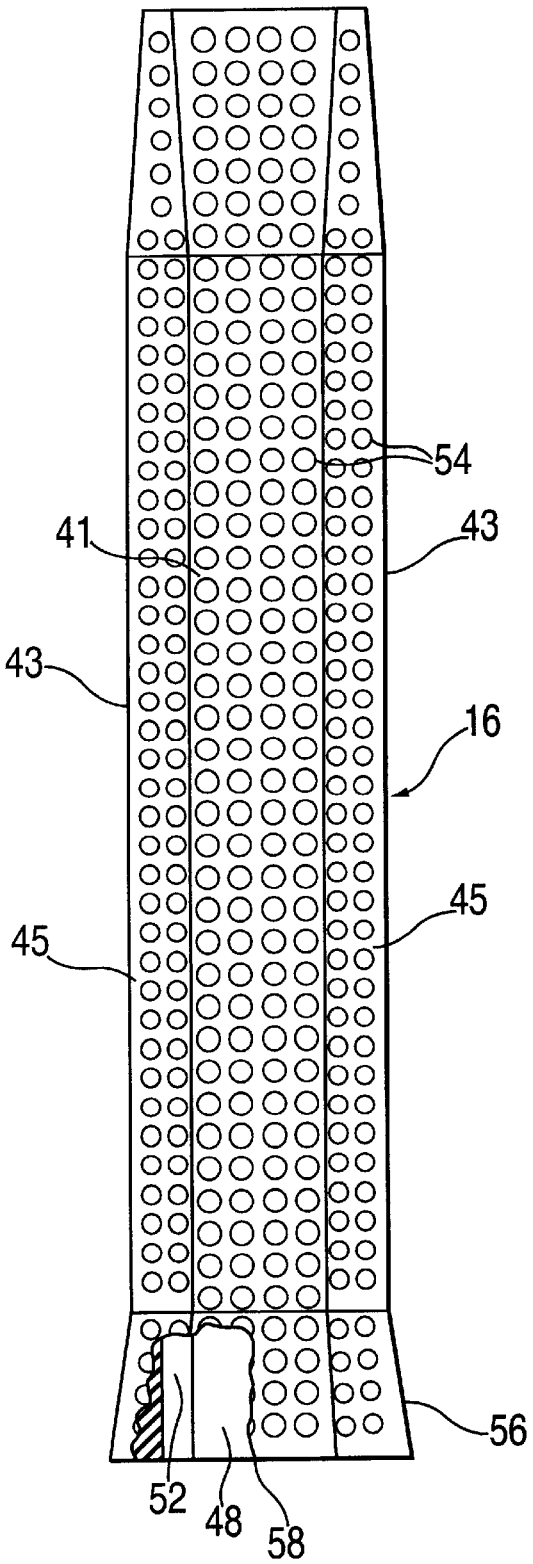
FIGS. 3, 4, 5 and 6 are plan, side, front and back views, respectively, of a pallet according to the invention.
Figure 4:
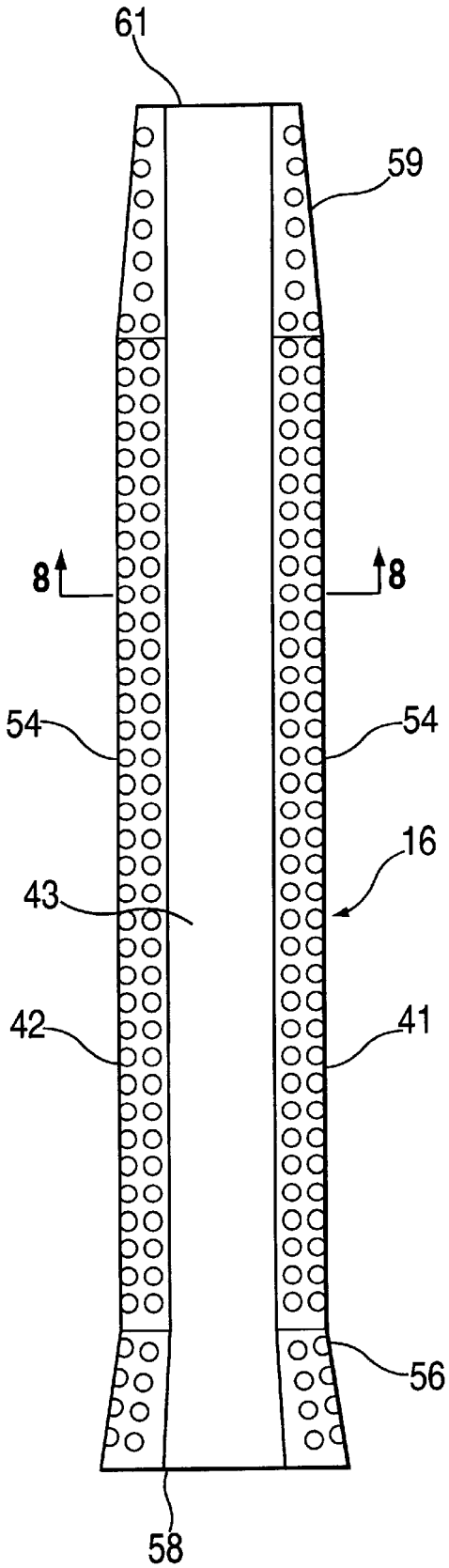
Figure 7:
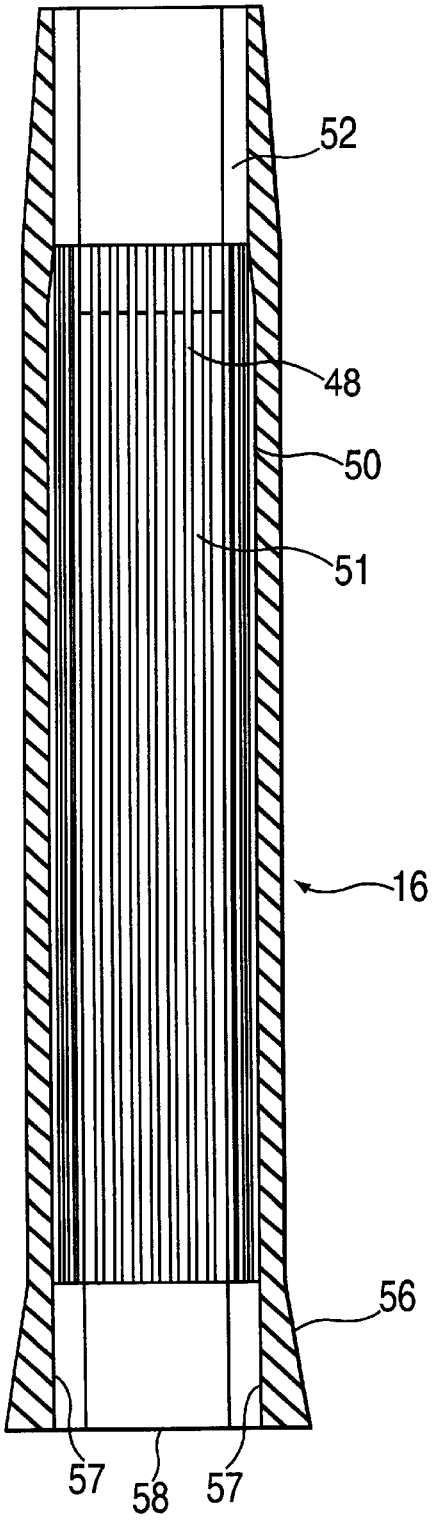
FIG. 7 is a longitudinal sectional view of the pallet shown in FIGS. 3–6.
Figure 5:
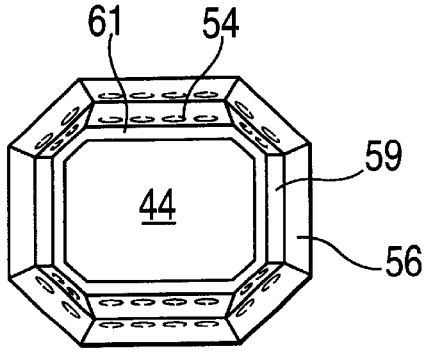
Figure 6:
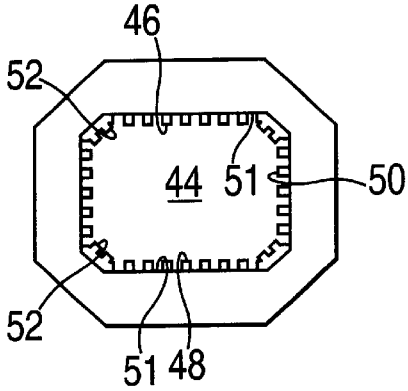
Figure 8:
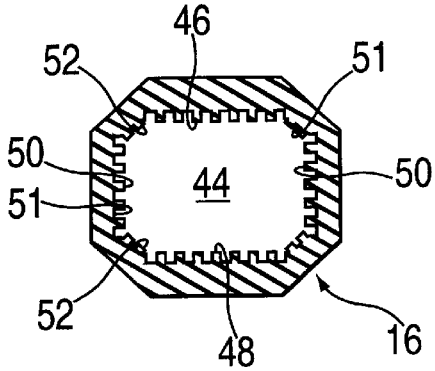
FIG. 8 is a cross-sectional view, on an enlarged scale, of the pallet taken through lines 8—8 of FIG. 4.

The hollow interior 44 of the pallet 16 is uniform along the length of the piece, so as to be able to slide onto the shaft 14. The inside dimensions of the interior, defined by the interior contact surfaces, may be sized slightly smaller than the shaft, for a force fit. The outside of the pallet 16 may be of uniform octagonal shape along its length, or may be given other configurations as desired. Preferably, the pallet is outwardly flared at the bottom end to define a butt portion 56, but once again other external configurations may be employed. The bottom 58 of the butt portion 56 may be closed or open. In the example shown, the bottom end 58 is open. Also, the outside surfaces at the forward end 59 of the handle 16 may taper inwardly toward edge 61, as shown in FIGS. 3–4, but the inside dimensions within space 44 should remain uniform. The butt portion 56 may be provided with an end plug (not shown), that may be positioned in the open end 58 of the pallet.

The outside of the pallet is formed with an array of holes 54 over the top 41, bottom 42 and diagonal 45 gripping surfaces. The holes in both the top and bottom surfaces and in the diagonal surfaces preferably extend perpendicular to the plane of the racquet head (i.e. perpendicular to the top and bottom surfaces of the handle), substantially, but preferably not all the way, through the pallet. The purpose of the holes is to increase elasticity of the handle. The holes also act to reduce weight and to facilitate the removal of the pallet from the mold core (which can otherwise be difficult with such a long piece). The holes may also be used to vary the softness over different parts of the handle. The number, size, shape, and spacing of the holes may be varied to produce the desired feel in the hand grip.

By way of example, holes of 3 mm diameter are spaced a distance of 4 mm (center-to-center) uniformly. The pallet interior 44 measures 25 mm (width) by 20 mm (height) with wall thicknesses of approximately 5 mm. The holes terminate approximately 1 mm from the inside surface of the pallet (i.e. to leave a 1 mm wall thickness). In a pallet having a top (and bottom) surface of 17 mm width, an overall width of 33 mm, and a length of 187 mm, 44 rows of holes may be provided, each row including 4 holes in the top (and bottom) surface and 2 holes to each side in the adjacent diagonal surfaces. The hole pattern can also be varied over different areas of the pallet surface, for example, to provide softer areas for the finger contact or to vary the firmness of the handle in the butt portion. Moreover, while in a tennis racquet handle it is preferable to provide holes in the top and bottom surface, and not the sides 43, of the pallet, in a squash racquet, due to its smaller size and the way it is gripped, it is desirable to include holes in the sides.

A frame in accordance with the invention may be formed of a fiber-impregnated resin material, e.g. graphite, in a known molding process, and producing the shaped handle portion 14 is a matter of adapting the shape of the mold in the shaft portion 14 to define the external octagonal configuration. As shown in FIG. 2, the abutting sides of the tubular profiles form a common wall 28 when molded. However, other materials may be employed to produce a suitable frame with a slide-on shaft portion.

Pallet 16 can be molded in a range of different outside dimensions corresponding to different size hand grips. Pallets of different exterior sizes are each provided with an interior 44 of a common size, so that any pallet 16 will fit on any racquet frame 10.

At such time as the pallet 16 is to be mounted on the frame 10, an adhesive such as double sided adhesive tape or other rubber adhesives are applied to the outside surface of the handle portion 14 of the racquet. The bottom end 34 of the frame 10 is then inserted into the open end of the pallet 16, as shown in FIG. 1, and the pallet 16 slides along the frame 14.

In view of the large contact area between the surfaces 20, 22, 24, and 26 of the frame portion 14 and the inside surfaces 46, 48, 50, 52 of the pallet 16, good bonding between the pieces occurs, and the pallet is mechanically supported in a secure manner on the frame as well. Thus, in the finished racquet, the pallet 16 is mounted as securely on the frame as in the case of known and presently used techniques for assembling the handle on the racquet.

Pallets 16 according to the invention are molded preferably of thermoplastic rubber, using known high pressure molding processes. Because the pallets are formed separate from the racquet, high pressure molding can be employed to make a pallet with any desired hole configuration and shape without damaging the composite structure of the racquet.

The pallet material is a relatively soft, solid elastomer, such term meaning that it is resilient but has significantly more strength, and a longer cycle durability, than a spongy foam. The material is preferably very elastic, with a quick recovery time. Rubber with approximately 55–60 Shore A Durometer is preferred, but other hardness ranges way also be used. Additional elasticity is provided, at the desired outside gripping surfaces, by the holes on the top, bottom, and diagonal handle surfaces. Together, the pallet material, ribs, and holes provide a comfortable grip, absorb shock, and help to dampen vibrations. Moreover, unlike conventional grips which have a hard butt cap covering the last 25 mm of the handle, the butt area of the pallet is soft. Even if the grip includes a hard butt plate, the flared portion remains soft to provide further cushioning in this critical area which otherwise tends to create more pressure on the hand.

Figure 9:
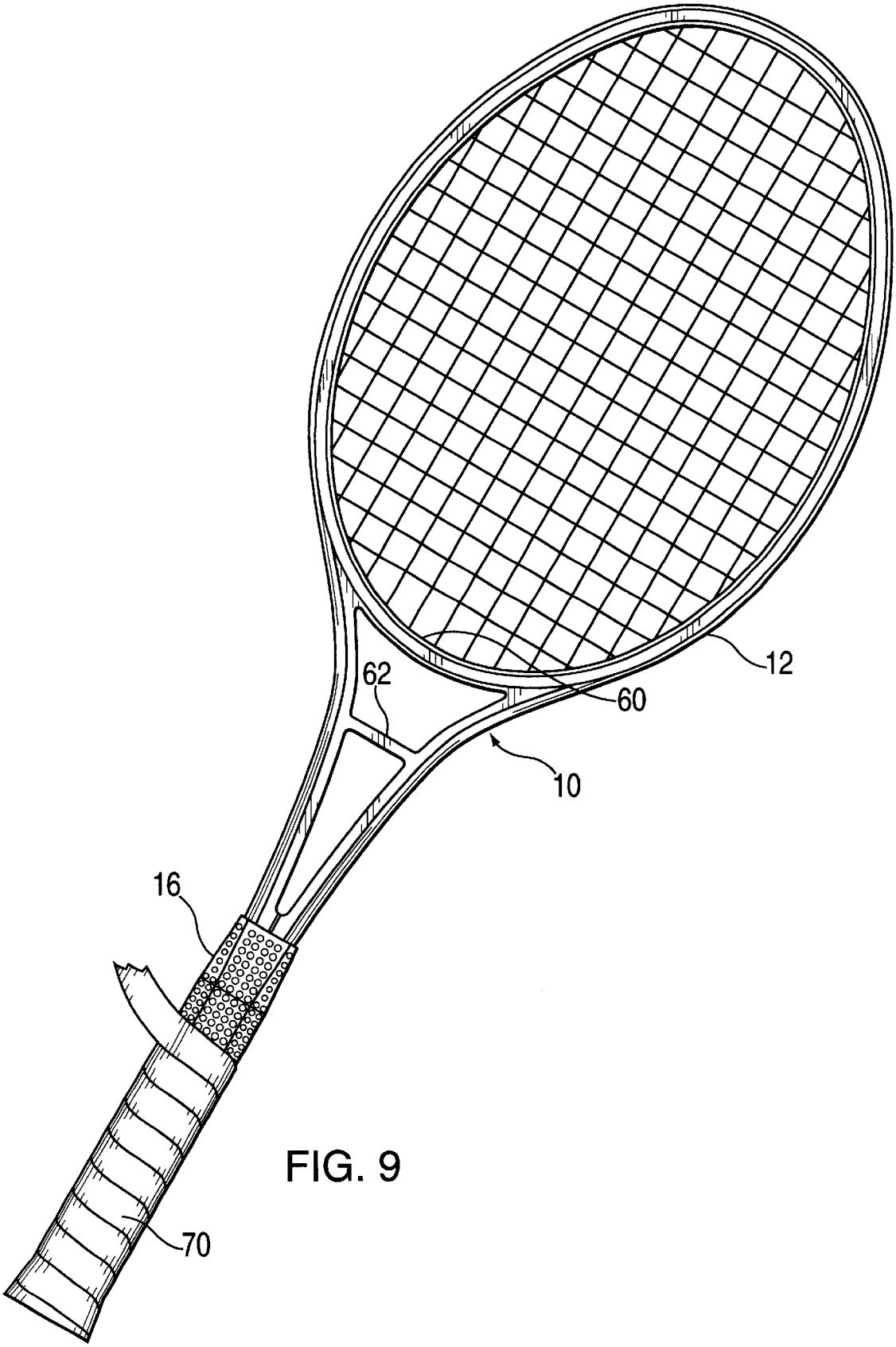
FIG. 9 is a plan view of a partially assembled tennis racquet in which the pallet includes an outer wrap.

Referring to FIG. 9, in the finished racquet the pallet is preferably wrapped, in order to provide a better gripping surface, with a soft, flexible outer wrap 70 such as known cloth-backed polyurethane. The wrap 70 may be applied after the pallet 16 is adhered to the shaft. Where an outer wrap is used, it should, as in the case of known polyurethane wraps, be very soft and flexible enough so as not to affect the resilient feel of the pallet. Alternatively, the pallet can be used alone as the handle. In the latter case, the holes also provide a positive gripping surface.

The frame 10 and pallets 16 of different sizes may be separately maintained in inventory, and formed into a finished racquet at such time as the manufacturer receives an order and ships the racquet. Alternatively, it is possible to supply racquets 10 and handles of different grip sizes to the retailer, to reduce the required inventory of racquets.

The foregoing represents a preferred embodiment of the invention. Variations and modifications of the embodiment described will be apparent to persons skilled in the art, without departing from the inventive concepts disclosed herein. Thus, while the invention has been described relative to its preferred implementation on tennis racquets, handles may also be fabricated for other types of racquets. Moreover, while the holes 54 on outside surfaces 41, 42, 45 are shown as cylindrical, holes of other shapes, including rectangular, oval or slotted, or grooves, may be employed, the term "hole" being meant to include any of such configurations. All such modifications and variations are intended to be within the scope of the invention, as set forth in the following claims.

We claim:

1. A racquet comprising a frame and a handle; wherein the frame includes a head and an axially extending shaft portion, wherein the shaft portion of the frame has an outer periphery; and wherein the handle includes a pallet formed of a solid elastomeric material, with an outside gripping surface and a hollow interior having inside surfaces conforming to the outer periphery of the shaft portion of the frame and forming contact surfaces therewith; and wherein said pallet further includes means for increasing the resiliency of the pallet in selected gripping areas, said means being in the form of an array of holes, located in at least one gripping area of the handle, the holes extending from the outside surface partially through the pallet toward the hollow interior.

2. A racquet according to claim 1, wherein the holes extend generally perpendicular to the frame axis.

3. A racquet as defined in claim 2, wherein the holes are at least generally cylindrical in shape.

4. A racquet as defined in claim 2, wherein the pallet is molded as a one piece unit, including a flared butt portion at a distal end, and wherein the butt portion includes an array of holes for cushioning.

5. A racquet according to claim 2, wherein the frame has a head portion lying generally in a plane, and wherein the pallet has outside surfaces which are generally octagonal in configuration and include top and bottom walls parallel to said plane, opposed sides perpendicular to said plane, and diagonal walls joining the sides to the top and bottom walls, wherein the array of holes is formed only in the top, bottom and diagonal walls, and wherein said holes extend generally perpendicular to said top and bottom surfaces and substantially through the respective walls.

6. A racquet as defined in claim 5, wherein the holes are at least generally cylindrical in shape.

7. A racquet as defined in claim 5, wherein the density of the hole pattern on the pallet outside surface is nonuniform so as to vary the softness of different areas of the handle.

8. A racquet as defined in claim 1, 2, 3, 4, 5, 6 or 7, wherein the handle includes an outer wrap of a soft, flexible wrap material over said pallet.

9. A slide-on pallet for forming the handle of a tennis racquet frame of the type having a shaft with opposed, parallel top and bottom surfaces and opposed sides, said pallet being molded of a solid elastomeric material with a hollow interior including opposed, parallel, top and bottom surfaces and opposed sides, the interior surfaces being sized to form contact surfaces with the shaft of a tennis racquet; and means for increasing the resiliency of the pallet in selected gripping areas, said means being in the form of an array of spaced holes on at least one gripping portion of said pallet extending inwardly toward said hollow interior.

10. A pallet according to claim 9, wherein the outside surfaces include a top surface and a bottom surface, wherein said array is provided on said surfaces, and wherein the holes extend perpendicular thereto and through the top and bottom walls of the pallet.

11. A pallet according to claim 10, wherein said handle includes opposed sides and diagonal surfaces joining the sides to the top and bottom surfaces, and holes are provided in said top, bottom, and diagonal surfaces only and extend perpendicular to the top and bottom surfaces.

12. A sports implement including a shaft with a distal end and a shaft portion of uniform cross section extending a distance from said end, and a handle including a one-piece, preformed, slide-on pallet on said shaft portion, said pallet being formed of a solid elastomeric material with a wall defining a hollow interior conforming to said shaft portion, and said pallet further having means for increasing the resiliency of the pallet in selected gripping areas, in the form of an array of holes, corresponding to at least one gripping area, extending generally perpendicular to the shaft axis partially through the wall towards the hollow interior, and wherein the handle comprises an outer wrap of a soft, flexible wrap material over said pallet.

13. A racquet according to claim 1 wherein the pallet with a uniform hollow interior conforms to the outer surface of a uniform shaft; and wherein the pallet is premolded such that the shaft portion of the racquet may be inserted into the hollow interior of the pallet which thereafter slides onto the shaft portion of the racquet for mounting, such that the outside surfaces of the shaft portion are in contact with the complimentary inside surfaces of the pallet.

14. A handle, comprising:

a premolded pallet formed of a solid elastomeric material, with an outside gripping surface and a hollow interior having inside surfaces conforming to the outer surface of the shaft portion of the frame;

wherein said pallet further includes an array of holes, located in at least one gripping area of the handle, the holes extending from the outside surface partially through the pallet toward the hollow interior;

wherein said pallet has outside surfaces which are generally octagonal in configuration, including top and bottom walls, and diagonal walls joining the sides to the top and bottom walls, having said holes through top and bottom walls; and wherein said pallet has an array of holes, corresponding to at least one gripping area, extending into said top, bottom, and diagonal walls.

* * * * *